US009556886B2

(12) United States Patent
Butz et al.

(10) Patent No.: US 9,556,886 B2
(45) Date of Patent: Jan. 31, 2017

(54) PRIMING AND LUBRICATING SYSTEM AND METHOD FOR MARINE PUMP IMPELLERS

(71) Applicant: Cummins Power Generation IP, Inc., Minneapolis, MN (US)

(72) Inventors: Kurt Butz, Edina, MN (US); Stephen W. Osmonson, Eagan, MN (US); Mark Turpin, Maple Grove, MN (US); Sathyanarayanan Arumugam, Shoreview, MN (US); John A. Peterson, Ramsey, MN (US)

(73) Assignee: CUMMINS POWER GENERATION IP, INC., Minneapolis, MN (US)

( * ) Notice: Subject to any disclaimer, the term of this patent is extended or adjusted under 35 U.S.C. 154(b) by 277 days.

(21) Appl. No.: 14/246,697

(22) Filed: Apr. 7, 2014

(65) Prior Publication Data

US 2015/0285265 A1 Oct. 8, 2015

(51) Int. Cl.

| | |
|---|---|
| ***F04B 23/08*** | (2006.01) |
| ***F04D 29/58*** | (2006.01) |
| ***F04D 13/16*** | (2006.01) |

(52) U.S. Cl.

CPC ..... *F04D 29/586* (2013.01); *F04D 13/16* (2013.01); *F01P 2050/04* (2013.01)

(58) Field of Classification Search

CPC ..... F04D 9/00; F04D 9/004; F04D 9/007; F04D 9/008; F04D 13/16; F04D 29/586; F01D 2050/04

See application file for complete search history.

(56) References Cited

U.S. PATENT DOCUMENTS

| | | | | |
|---|---|---|---|---|
| 1,993,267 | A * | 3/1935 | Ferguson | F04D 9/02 415/11 |
| 1,997,418 | A * | 4/1935 | Hornschuch | F04D 9/005 137/115.01 |
| 2,057,570 | A * | 10/1936 | Haentjens | F04D 9/006 417/89 |
| 3,068,802 | A * | 12/1962 | Costello | F04D 9/02 415/11 |
| 3,393,564 | A * | 7/1968 | Simmons | F04D 13/16 122/379 |
| 3,695,776 | A * | 10/1972 | Rule | F04D 9/02 415/182.1 |
| 4,515,180 | A * | 5/1985 | Napolitano | F04D 9/02 137/565.17 |
| 4,565,534 | A | 1/1986 | Bland | |
| 4,637,778 | A | 1/1987 | Pollari | |
| 4,781,529 | A * | 11/1988 | Rose | F04D 9/005 415/169.1 |
| 5,449,280 | A | 9/1995 | Maki et al. | |

(Continued)

FOREIGN PATENT DOCUMENTS

| | | |
|---|---|---|
| WO | WO-2011/017708 | 2/2011 |
| WO | WO-2011/160346 | 12/2011 |

*Primary Examiner* — Charles Freay
(74) *Attorney, Agent, or Firm* — Foley & Lardner LLP

(57) ABSTRACT

A marine pumping system includes a pump for providing a cooling fluid to, for example, an internal combustion engine. The pumping system includes a pump, a reservoir separate from and upstream of the pump for storing cooling fluid, and plumbing downstream of the pump configured to maintain cooling fluid in the reservoir during non-operation of the pump. The reservoir and plumbing configuration minimize dry run time of the pump.

20 Claims, 6 Drawing Sheets

(56) References Cited

U.S. PATENT DOCUMENTS

| | | | | |
|---|---|---|---|---|
| 6,071,072 | A * | 6/2000 | Chang | F04D 9/02 415/56.2 |
| 7,866,942 | B2 | 1/2011 | Harvie | |
| 2010/0112877 | A1 * | 5/2010 | McChesney | F01P 3/202 440/88 R |
| 2011/0030822 | A1 * | 2/2011 | Bear | F04B 49/02 137/565.34 |
| 2011/0038713 | A1 | 2/2011 | Harvie | |

* cited by examiner

PRIMING AND LUBRICATING SYSTEM AND METHOD FOR MARINE PUMP IMPELLERS

BACKGROUND

The present invention relates to marine power systems, and more particularly, but not exclusively, relates to priming and lubricating systems and methods for marine pump impellers.

In marine power systems, pumps are used to circulate cooling fluid to the engine and/or exhaust system to provide cooling. In some applications, the cooling fluid is drawn into the pump from the water on which the craft is operating. Thus, long runs of hoses and other plumbing may be required to reach the water source. Long plumbing runs as well as screens and filters that remove materials from the cooling fluid prior to the pump tend to increase the "dry" pumping time of the pump when the cooling system is primed and operation of the pump is initiated.

Many marine pumps use impellers made from an elastomer or other suitably flexible material. Dry running time operation of the pump causes the impeller to run in a dry pump housing without lubrication, which heats the impeller. Heating of the impeller causes it to harden over time, which decreases the flexibility of the blades and increases the wear, tear, and breakage of the impeller. Therefore, additional contributions in this area of technology are needed.

SUMMARY

Embodiments of the present application include unique systems, methods and techniques for wetting and lubricating pump impellers of pumping systems in marine applications. Other embodiments include unique systems, devices, methods, and apparatus involving marine pumping systems. Further embodiments, forms, features, aspects, benefits, and advantages of the present application shall become apparent from the description and figures enclosed herewith.

BRIEF DESCRIPTION OF THE DRAWINGS

The description herein makes reference to the accompanying drawings wherein like reference numerals refer to like parts throughout the several views.

DETAILED DESCRIPTION OF REPRESENTATIVE EMBODIMENTS

Figure 1:
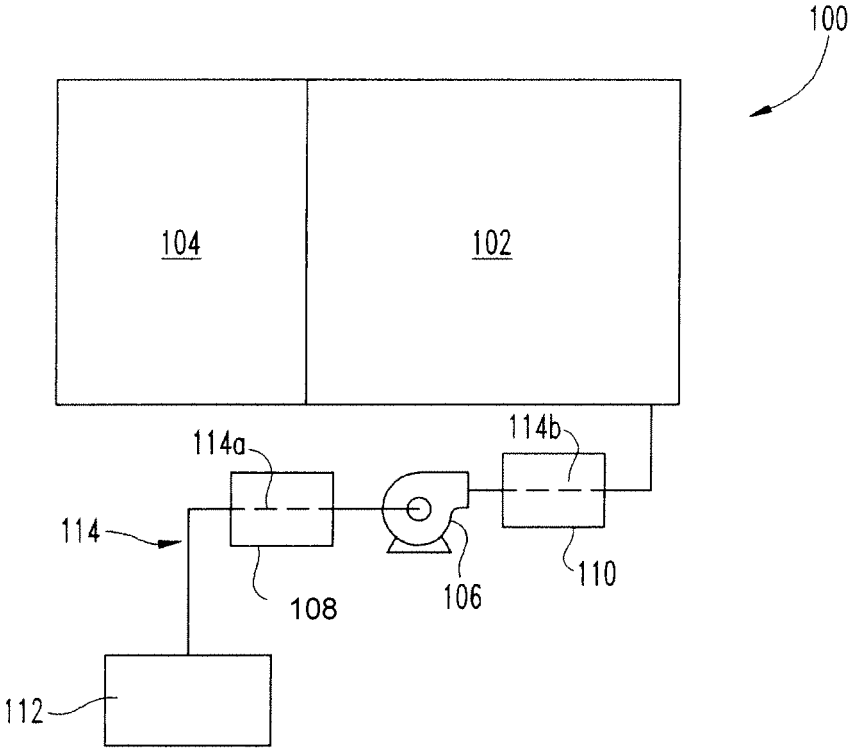
FIG. 1 is a schematic view of a marine pumping system according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the illustrated devices, and any further applications of the principles of the inventions illustrated and/or described being contemplated as would normally occur to one skilled in the art to which the invention relates.

Referring to FIG. 1, there is shown generally a power system 100 with an engine 102 and a generator 104 that comprise a genset. Power system 10 includes a cooling fluid pump 106 that is operable to provide a cooling fluid flow to, for example, engine 102 from a cooling fluid source 112. Pump 106 includes an impeller that is made from a flexible material, such as an elastomer, although any flexible material suitable for an impeller is contemplated.

Pump 106 can be connected to cooling fluid source 112 and engine 102 with a conduit 114. Conduit 114 is further connected to a reservoir 108 upstream of pump 106 and to a cooling fluid retention device 110 downstream of pump 106. Reservoir 108 includes a chamber to store a quantity of cooling fluid that is readily available to pump 106 art start-up to eliminate or reduce dry run-time conditions of pump 106, thus extending the operating life and performance of the flexible impeller. Cooling fluid retention device 110 is configured to return at least a portion of the cooling fluid to pump 106 and/or reservoir 108 when operation of pump 106 is terminated. The return of cooling fluid by cooling fluid retention device 110 wets and/or lubricates the flexible impeller and provides cooling fluid for storage in reservoir 108 that, as discussed above, eliminated or reduced dry-run time of pump 106 at start-up.

In one embodiment, a retrofit of an existing pumping system includes adding reservoir 108 and cooling fluid retention device 110 to an existing pump 106 mounted on or near engine 102 that is also connected directly with cooling fluid source 112 and engine 102 with conduit 114. In the retrofit, a first section 114*a* of conduit 114 is removed and reservoir 108 is installed and connected to conduit 114 upstream and downstream of the removed section 114*a*. In addition, a second section 114*b* of conduit 114 is removed and cooling fluid retention device 110 is connected to conduit 114 upstream and downstream of removed section 114*b*. Alternatively, conduit 114 can be replaced entirely or partially with one or more new conduits in order to connect reservoir 108 on its downstream side with pump 106 and on its upstream side with cooling fluid source 112, and to connect cooling fluid retention device 110 on its upstream side with an outlet of pump 106 on its downstream side with engine 102.

Figure 2:
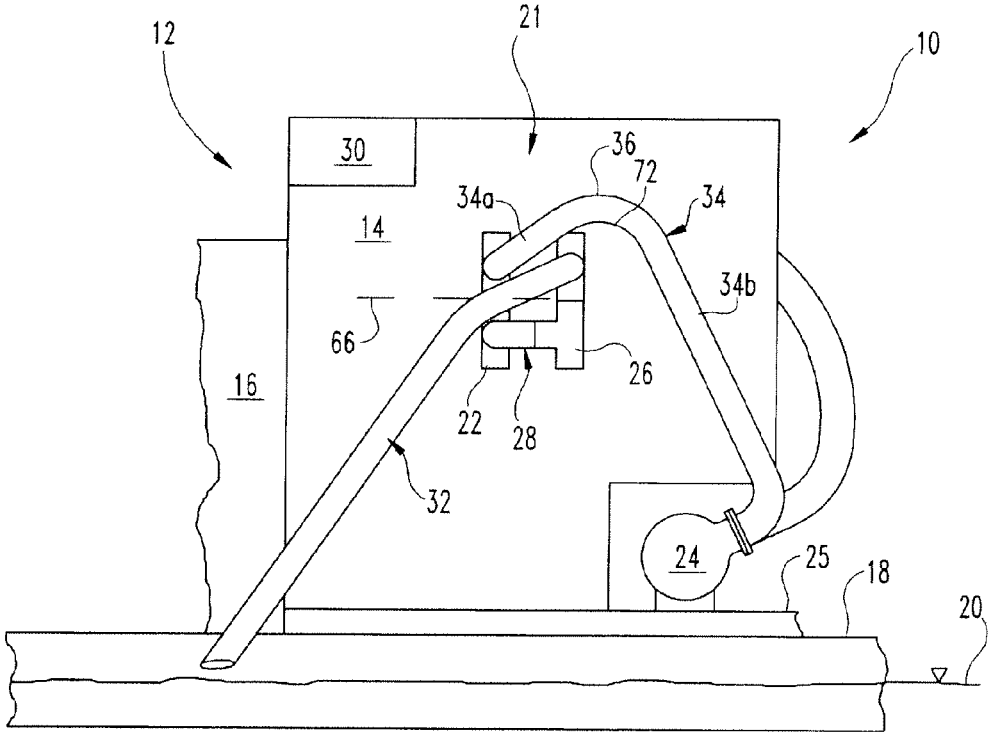
FIG. 2 is a diagrammatic elevation view of a marine power system according to one embodiment.
Figure 3:
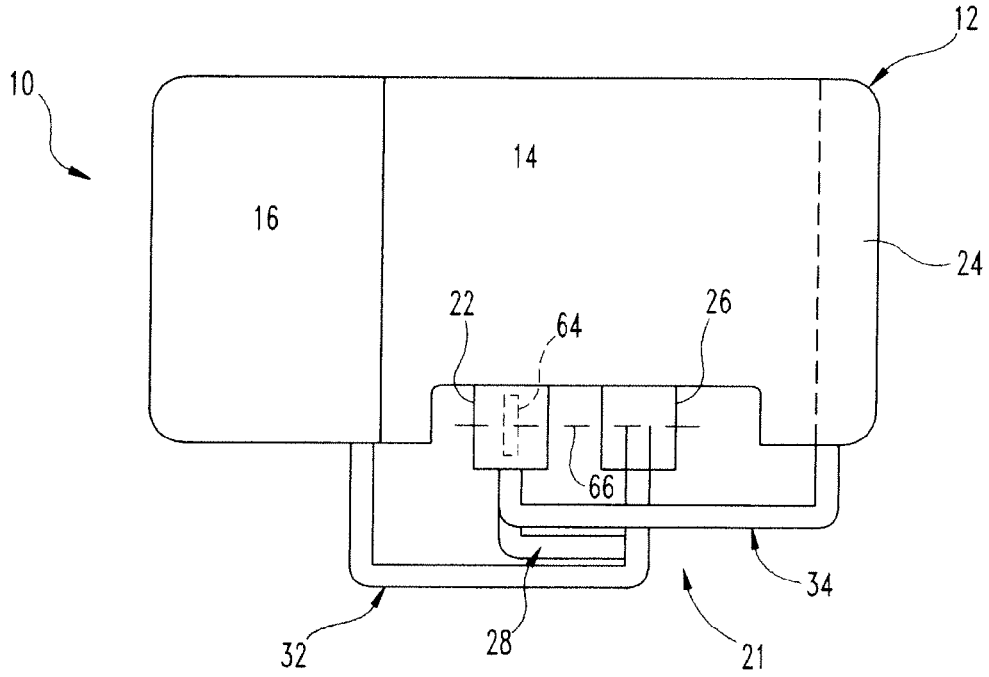
FIG. 3 is a schematic plan view of the marine power system of FIG. 2.

FIGS. 2 and 3 illustrate one embodiment of a marine system 10 including a power system 12 such as a genset that may be used, for example, in marine applications. Power system 12 includes an internal combustion engine 14 that is operably connected to at least one generator 16 that provides electrical power, converting mechanical energy to electrical energy. Embodiments in which engine 14 is not connected to generator 16 are also contemplated, such as applications where engine 14 provides mechanical power to propel watercraft 18 through water 20. The engine 14 may be any type of combustion or reciprocating piston type engine that uses gasoline, diesel, gaseous, hybrid fuel, or fueled in a different manner as would occur to those skilled in the art. Watercraft 18 may be any suitable boat or other vehicle that moves along or in water 20 for transportation.

In one embodiment, the generator 16 is operable to generate electrical power at a generally constant speed to provide a generally fixed AC electrical power output frequency, but may vary in speed in other arrangements or embodiments. In one embodiment, the rotational operating speed of engine 14, and correspondingly rotational speed of the generator 16 vary over a selected operating range in response to, for example, changes in electrical loading of power system 12. Over this range, genset rotational speed increases to meet larger power demands concomitant with an increasing electrical load on power system 12. For example, power system 12 may include one or more rectifiers to convert AC power from the generator 16 to DC power. Power system 12 may also include a DC bus coupled to the rectifier so equipment can utilize the DC power. Power system 12 may further include one or more inverters coupled to the DC bus to convert the DC power to AC power. Equipment requiring AC power may utilize the AC power from the inverter. In one such arrangement, a variable speed genset is utilized that provides variable frequency AC to a rectifier. The rectifier outputs a DC voltage that can be used to output DC power to other devices either through a DC/DC converter, or otherwise. This DC bus can also be used as an input to one or more inverters to provide corresponding fixed frequency AC outputs. Accordingly, a variable speed genset can be utilized to provide a fixed frequency AC output with such arrangements.

Power system 12 is further mounted to a base 25 that is secured to watercraft 18. In one embodiment, base 25 is any suitable platform for mounting of a genset. The power system 12 includes a pumping system 21 with a cooling fluid pump 22 that is operable to circulate cooling fluid to, for example, a heat exchanger 24 associated with engine 14 and/or one or more exhaust components of engine 14. Pumping system 21 further includes a reservoir 26 that is separate from and upstream of pump 22. Pump 22 and reservoir 26 are mounted to engine 14, and an inlet of pump 22 is connected to an outlet of reservoir 26 with a connecting conduit 28. An inlet conduit 32 extends from an inlet to reservoir 26 to a source of cooling fluid, such as water 20 or a storage tank (not shown) that is connected to and receives cooling fluid, such as water 20 or other coolant. An outlet conduit 34 extends from an outlet of pump 22 to heat exchanger 24 or other component of the cooling circuit of engine 14. Outlet conduit 34 is connected to or forms a cooling fluid retention device that, as discussed further below, is configured to retain at least a portion of the cooling fluid pumped by pump 22 upon stopping or unsuccessful starting of pump 22. The retained cooling fluid is returned to pump 22 and/or reservoir 26 for lubrication and priming of pump 22 on subsequent pump starting events.

The operation of engine 14 and pump 22 can be regulated by a controller 30, which is sometimes designated an Engine Control Module (ECM). Likewise there is a controller for operation of power system 12 that may be a part of the ECM or separate in one or more respects. In other words, one or more separate control devices may be used that are designated herein as a controller 30. Controller 30 can be responsive to control signals from sensors and execute operating logic that defines various control, management, and/or regulation functions. In one embodiment of a system and method disclosed herein, controller 30 is connected to pump 22 and pump 22 is operable in response to control signals from controller 30 to start and stop operation in response to a cooling fluid demand. In other embodiments, pump 22 is operable in response to signals from one or more sensors indicating a demand for cooling fluid.

Figure 4:
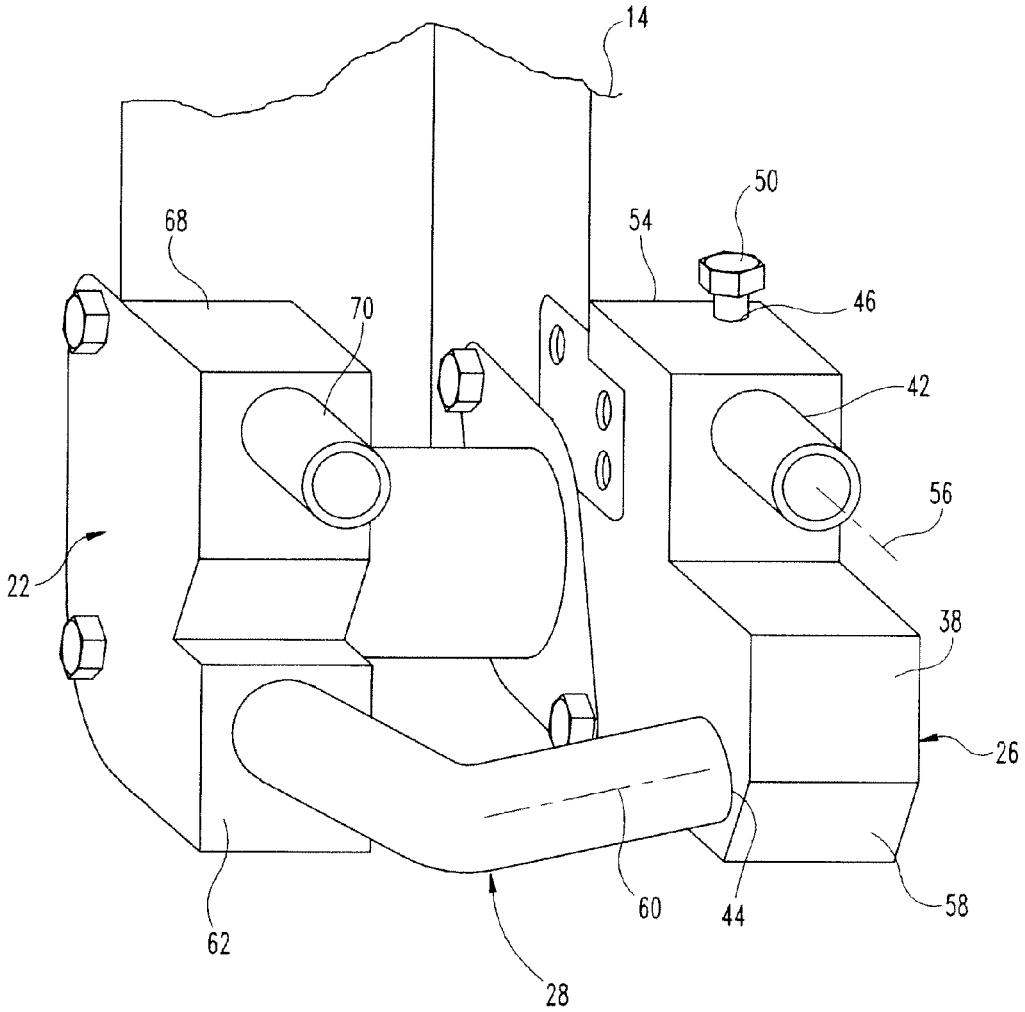
FIG. 4 is a perspective view of one embodiment of a marine pumping system of the systems of FIGS. 1 and 2.
Figure 5:
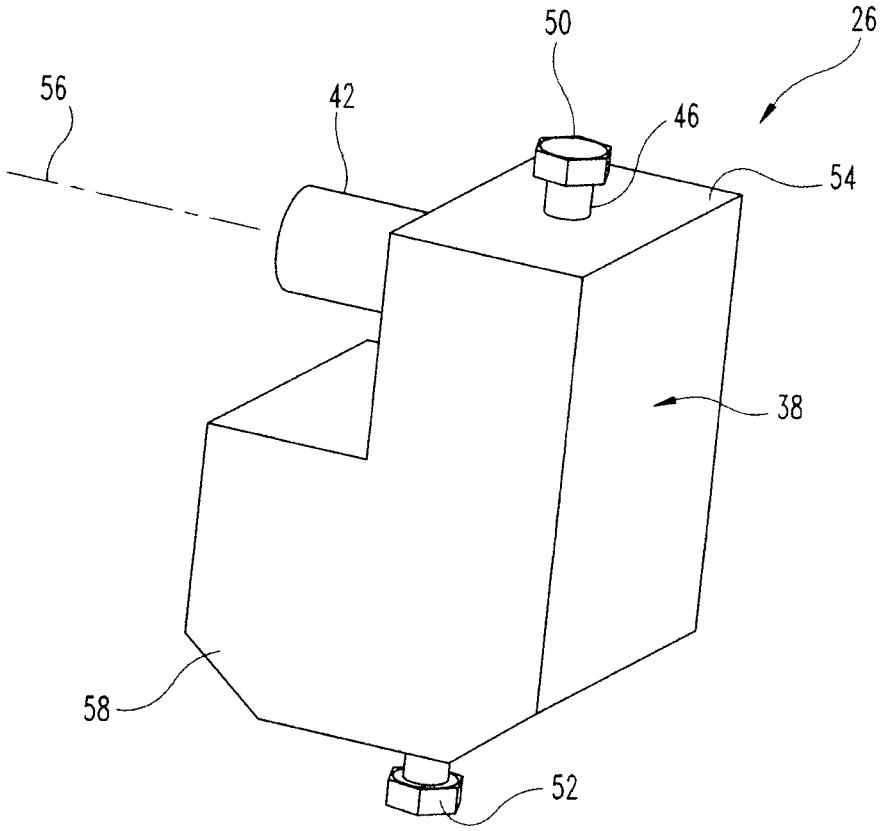
FIG. 5 is a perspective view of a reservoir of the marine pumping system of FIG. 4.
Figure 6:
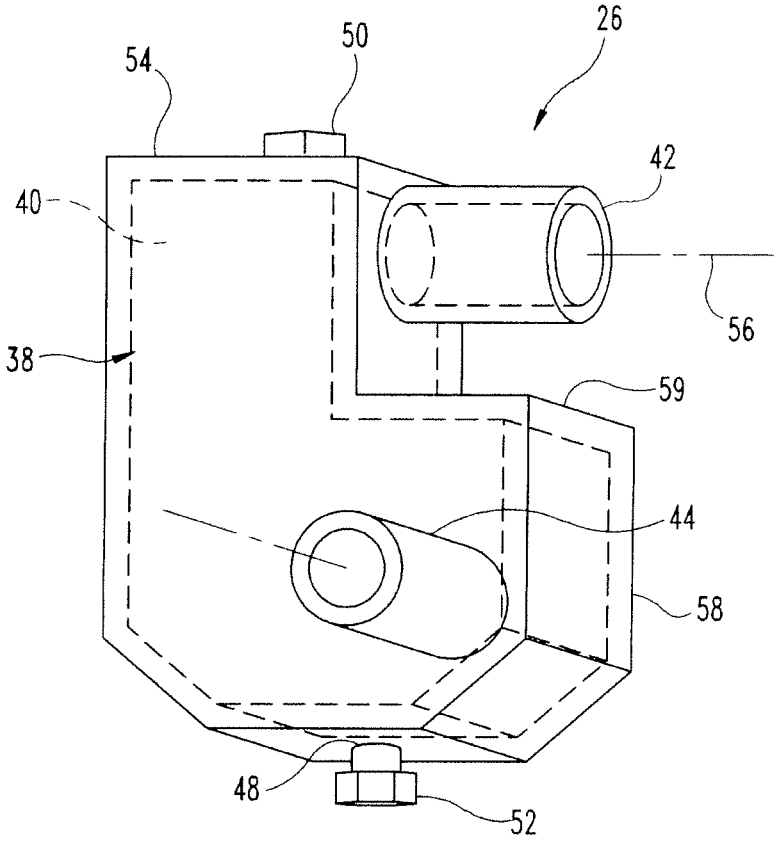
FIG. 6 is another perspective view of the reservoir of FIG. 5.

Referring further to FIGS. 4-6, one embodiment of reservoir 26 includes a body 38 defining an interior chamber 40 for retaining a quantity of cooling fluid suitable for initiating priming and lubrication of impeller 64. Chamber 40 is in fluid communication with an inlet 42 and an outlet 44 extending from body 38. In addition, body 38 includes a fill port 46 at an upper end of body 38 and a drain port 48 at a lower end of body 38. Fill port 46 can be opened by removing a fill plug 50 and used at set-up or at a service event of power system 12 to provide cooling fluid directly into chamber 40 so that it is readily and quickly available to pump 22 at start-up or priming of the cooling system. Drain port 48 can be opened by removing a drain plug 52 so that chamber 40 can be drained for service or storage of power system 12.

Body 38 can include an L-shaped configuration with a first, upper portion 54 that includes inlet 42 projecting therefrom along a first axis 56. Body 38 also includes a second, lower portion 58 with outlet 44 extending therefrom along a second axis 60. Inlet 42 extends outwardly from first portion 54 and above a foot 59 of the lower second portion 58 for connection with inlet conduit 32. The inward offset of first portion 54 relative to second portion 58 allows inlet conduit 32 to maintain a low profile relative to reservoir 26 at its connection therewith. Outlet 44 extends from foot 59 and is oriented toward pump 22 so that connecting conduit 28 maintains a low profile as it extends from reservoir 26 to its connection with inlet 62 of pump 22.

Pump 22 includes an impeller 64 mounted in a housing of pump 22, and impeller 64 *t* rotates about a rotation axis 66. When rotation of impeller 64 is initiated, cooling fluid is drawn from reservoir 26 through connecting conduit 28 and into housing 68 of pump 22 to lubricate impeller 64. In one embodiment, impeller 64 is made from a flexible material such as an elastomer or rubber. In dry run conditions of pump 22, impeller 64 can contact housing 68 of pump 22 and/or increase in heat, which can cause impeller 22 to lose flexibility, increase in wear, and tear or break. Reservoir 26 provides a close source of readily available cooling fluid to lubricate and cool impeller 64 during start-up and to initiate priming, reducing or eliminating dry run time conditions for pump 22.

Pump 22 includes an outlet 70 extending from body 68 that is connected to outlet conduit 34 to provide cooling fluid to heat exchanger 24 or other cooling circuit of power system 12. Outlet conduit 34 includes a portion that forms a cooling fluid retention device 36 that is located above outlet 70 and inlet 62 of pump 22. Cooling fluid retention device 36 can also be located above inlet 42 and outlet 44 of reservoir 26, although other configurations are contemplated. When operation of pump 22 is stopped, cooling fluid that has not traveled in outlet conduit 34 downstream of retention device 36 is returned by gravity flow to pump 22, thus lubricating impeller 64, and from pump 22 through connecting conduit 28 to chamber 40 of reservoir 26. The cooling fluid that drains from pump 22 to chamber 40 of reservoir 26 provides a ready source of closely available cooling fluid for the next start-up event for pump 22. Thus, pump 22 is not subjected to long dry run times that would be needed to draw cooling fluid from the cooling fluid source through the entire length of inlet conduit 32. In the illustrated embodiment, the location of inlet 42 of reservoir 26 above rotation axis 66 also allows impeller 64 to remain at least partially submerged in cooling fluid when pump 22 is not operating provided a sufficient volume of cooling fluid is retained by retention device 36. Other arrangements are also contemplated, such as inlet 42 being located at or below rotation axis 66, and embodiments in which the rotation axis 66 extends parallel or obliquely to inlet 42.

Third conduit 34 includes a first tubular portion 34*a* that extends upwardly from outlet 70 of pump 22 in an oblique orientation to rotation axis 66, and a second tubular portion 34*b* that extends downwardly and transversely to first tubular portion 34*a* in an oblique orientation to rotation axis 66.

Outlet conduit 34 in the illustrated embodiment is configured with a tubular bend that forms cooling fluid retention device 36 at the apex of the connection of first and second tubular portions 34*a*, 34*b*. In the illustrated embodiment, the bend is about 90 degrees. Other embodiments contemplate the angle defined by the bend is less than 180 degrees. The bend defines a concave side 72 along which inlet conduit 32 transversely extends to its connection with reservoir inlet 42. In one embodiment, cooling fluid retention device 36 is formed by molding a conduit or a conduit section to the desired hump-shaped configuration such as shown in FIG. 2.

Pumping system 21 can be provided as an originally manufactured or installed part of power system 12. In other embodiments, pumping system 21 is formed by modifying an existing pumping system of a power system that includes a pump 22. For example, pump 22 can be an original or existing component of the power system 12, and reservoir 26 along with conduits 28, 32 and 34 can be provided and added to the power system 12 to retrofit the power system 12 to provide it with pumping system 21.

Various aspects of the disclosure herein are contemplated. According to one aspect, a method includes operating a pump having an impeller to prime a cooling circuit of an internal combustion engine by drawing cooling fluid from a fluid source into a reservoir and by drawing cooling fluid from the reservoir into the pump; terminating operation of the pump; draining a portion of the cooling fluid between the pump and the cooling circuit through the pump to the reservoir after terminating operation of the pump; and storing the cooling fluid in the reservoir.

In one embodiment of the method, draining the portion of the cooling fluid includes positioning a cooling fluid retention device, such as a bend in a conduit, between the pump and the cooling circuit downstream of and above an outlet of the pump and above an inlet to the reservoir. In another embodiment, the method includes filling the reservoir with cooling fluid before operating the pump. In another embodiment, the method includes driving an electric power generator by operating the internal combustion engine. In another embodiment of the method, the reservoir includes an inlet for receiving the cooling fluid that is positioned above an outlet of the reservoir, the pump includes an outlet that is positioned above an inlet of the pump, and the inlet to the pump is connected to the outlet of the reservoir with a connecting conduit.

In another embodiment, a method includes retrofitting a cooling system that includes a pump mounted to an engine. The retrofitting method includes modifying an existing cooling system by mounting the reservoir to the engine, connecting an outlet of the reservoir to an inlet of the pump with a connecting conduit, connecting an inlet of the reservoir to the fluid source with an inlet conduit, and connecting an outlet of the pump to the cooling circuit with a cooling fluid retention device therebetween. The cooling fluid retention device can be formed at least in part by a tubular bend in a conduit and can be positioned above the inlet and the outlet of the pump, and can also be positioned above the inlet and the outlet of the reservoir.

According to one aspect, a system, method and apparatus includes a pump including a housing and a flexible impeller rotatably mounted in the housing about a rotation axis. There is further provided a reservoir including a body defining an inlet and an outlet. The body defines a chamber for storing a quantity of cooling fluid in fluid communication with the inlet and the outlet of the reservoir. The inlet of the reservoir is also connected to a source of cooling fluid and a conduit connects the outlet of the reservoir to the inlet of the pump. A cooling fluid retention device is connected in fluid communication with the outlet of the pump. The cooling fluid retention device is located above the outlet of the pump and the inlet to the reservoir so that when operation of the pump is terminated at least a portion of the cooling fluid that is downstream of the outlet of the pump is returned by gravity through the pump to the reservoir.

In one embodiment, the impeller is comprised of an elastomer. In another embodiment, the retention device is formed by a bend defining an apex of a second conduit. In one refinement of this embodiment, the bend in the second conduit defines a concavely curved side and the first conduit extends transversely to the second conduit along the concavely curved side to the inlet of the reservoir. In another refinement of this embodiment, the bend defines an angle that is less than 180 degrees.

In another embodiment, the body of the reservoir includes a first portion from which the inlet extends on a first axis and a second portion below the first portion that includes a foot extending outwardly from the first portion along the first axis. The outlet extends outwardly from the foot along a second axis that is orthogonal to the first axis. In one refinement of this embodiment, the cooling fluid retention device includes a tubular bend that connects a first tubular portion extending from the outlet of the housing of the pump to a second tubular portion that is substantially transversely oriented to the first tubular portion.

According to one aspect, a system, method and apparatus includes an internal combustion engine with a cooling circuit for circulating a cooling fluid and a pump including a housing mounted to the internal combustion engine. The pump includes a flexible impeller rotatably mounted in the housing about a rotation axis and the housing includes an inlet and an outlet. There is further provided a reservoir including a body defining a chamber for storing cooling fluid. The body includes an inlet connected to a source of cooling fluid and an outlet connected to the inlet of the pump with a conduit. The inlet and the outlet are in fluid communication with the chamber, and the reservoir is mounted to the internal combustion engine. A cooling fluid retention device is in fluid communication with the outlet of the pump and the cooling circuit. The retention device is configured to return at least a portion of the cooling fluid downstream of the pump to the pump and the reservoir when operation of the pump is terminated.

According to one embodiment, the internal combustion engine is operably connected to an electric power generator. In another embodiment, the impeller is comprised of elastomer. In yet another embodiment, the cooling fluid retention device comprises a tubular bend connecting a first tubular portion extending outwardly from the outlet of the pump to a second tubular portion that is connected to the cooling circuit. In one refinement of this embodiment, the tubular bend is located above the outlet of the pump and the inlet of the reservoir and forms an angle of less than 180 degrees between the first and second tubular portions.

In another embodiment, the source of cooling fluid is a body of water. In yet another embodiment, the body of the reservoir includes a first portion with the inlet extending therefrom along a first axis and a second portion below the first portion that includes a foot that extends outwardly from the first portion along the first axis. The outlet extends outwardly from the foot along a second axis that is orthogonal to the first axis.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A marine pumping system, comprising:

a pump including a housing and a flexible impeller rotatably mounted in the housing about a rotation axis, the housing including an inlet and an outlet;

a reservoir including a body defining an inlet and an outlet, the body further defining a chamber for storing a quantity of cooling fluid in fluid communication with the inlet and the outlet of the reservoir, wherein the inlet is connected to a source of cooling fluid, the reservoir including a fill port at an upper end of the body and a drain port at a lower end of the body;

a first conduit connecting the outlet of the reservoir to the inlet of the pump; and a cooling fluid retention device formed by a bend defining an apex of a second conduit that extends down from the apex to connect the outlet of the housing of the pump to a cooling circuit including a heat exchanger, wherein the cooling fluid retention device is located above and in fluid communication with the outlet of the pump and the inlet to the reservoir so that when operation of the pump is terminated at least a portion of the cooling fluid downstream of the pump is returned by gravity to the pump to wet the impeller and to the reservoir for storage to prime the pump when the pump is started.

2. The apparatus of claim 1, wherein:

the inlet of the pump is below the rotation axis and the outlet of the pump is above the rotation axis; and the inlet of the reservoir is above the outlet of the reservoir.

3. The apparatus of claim 1, further comprising:

an inlet conduit connected to the inlet of the reservoir, wherein a portion of the inlet conduit upstream of the inlet of the reservoir transversely extends alongside a portion of the second conduit upstream of the bend, to its connection with the inlet of the reservoir.

4. The apparatus of claim 1, wherein the impeller is comprised of an elastomer.

5. The apparatus of claim 1, wherein the body of the reservoir includes a first portion from which the inlet extends on a first axis, a second portion below the first portion that includes a foot extending outwardly from the first portion along the first axis, wherein the outlet of the reservoir extends outwardly from the foot along a second axis that is orthogonal to the first axis.

6. The apparatus of claim 5, wherein the cooling fluid retention device is formed by a tubular bend that connects a first tubular portion extending from the outlet of the housing of the pump to a second tubular portion that is substantially transversely oriented to the first tubular portion.

7. A marine power system, comprising:

an internal combustion engine including a cooling circuit for circulating a cooling fluid;

a pump including a housing mounted to the internal combustion engine, the pump including a flexible impeller rotatably mounted in the housing about a rotation axis, the housing further defining an inlet and an outlet;

a reservoir including a body defining a chamber for storing cooling fluid, the body including an inlet connected to a source of cooling fluid and an outlet connected to the inlet of the pump with a first conduit, wherein the inlet and the outlet of the body of the reservoir are in fluid communication with the chamber, the reservoir including a fill port at an upper end of the body and a drain port at a lower end of the body; and a cooling fluid retention device formed by a bend defining an apex of a second conduit that extends down from the apex to connect the outlet of the pump to the cooling circuit including a heat exchanger, wherein the cooling fluid retention device is configured to return cooling fluid through the pump to the reservoir when operation of the pump is terminated.

8. The system of claim 7, wherein the reservoir is mounted to the internal combustion engine with the inlet of the reservoir above the inlet of the pump, and the outlet of the reservoir below the inlet of the reservoir.

9. The system of claim 7, wherein the internal combustion engine is operably connected to an electric power generator.

10. The system of claim 7, wherein the impeller is comprised of an elastomer.

11. The system of claim 7, wherein the cooling fluid retention device comprises a tubular bend that connects a first tubular portion extending outwardly from the outlet of the pump to a second tubular portion connected to the cooling circuit.

12. The system of claim 11, wherein the tubular bend is located above the outlet of the pump and the inlet of the reservoir and the tubular bend forms an angle between the first and second tubular portions.

13. The system of claim 7, wherein the source of cooling fluid is a body of water.

14. The system of claim 7, wherein the body of the reservoir includes a first portion with the inlet extending therefrom along a first axis, a second portion below the first portion that includes a foot that extends outwardly from the first portion along the first axis, wherein the outlet of the reservoir extends outwardly from the foot along a second axis that is orthogonal to the first axis.

15. A method, comprising:

operating a pump having an impeller to prime a cooling circuit of an internal combustion engine by drawing cooling fluid from a fluid source into a reservoir and by drawing cooling fluid from the reservoir into the pump, the reservoir including a fill port at an upper end of the body and a drain port at a lower end of the body;

terminating operation of the pump;

draining a portion of the cooling fluid retained in a cooling fluid retention device located between the pump and the cooling circuit through the pump to the reservoir after terminating operation of the pump, wherein the cooling fluid retention device is formed by a bend defining an apex of an outlet conduit that extends down from the apex to connect the pump to the cooling circuit including a heat exchanger; and storing the cooling fluid in the reservoir.

16. The method of claim 15, wherein the bend is above an outlet of the pump and above an inlet to the reservoir.

17. The method of claim 15, further comprising filling the reservoir with cooling fluid before operating the pump.

18. The method of claim 15, further comprising driving an electric power generator by operating the internal combustion engine.

19. The method of claim 15, wherein the reservoir includes an inlet for receiving the cooling fluid and an outlet connected to an inlet of the pump with a conduit.

20. The method of claim 15, further comprising retrofitting a pumping system that includes the pump mounted to the engine, wherein retrofitting the pumping system includes mounting the reservoir to the engine, connecting the outlet of the reservoir to the inlet of the pump with a connecting conduit, connecting the inlet of the reservoir to the fluid source with an inlet conduit, and connecting the outlet of the pump to the cooling circuit with the outlet conduit, wherein the outlet conduit includes the cooling fluid retention device that is positioned above the outlet of the pump.

* * * * *